US006005203A

United States Patent [19]

Balaban

[11] Patent Number: 6,005,203

[45] Date of Patent: Dec. 21, 1999

[54] IN-LINE SWITCH ASSEMBLY

[75] Inventor: David B. Balaban, Hauppauge, N.Y.

[73] Assignee: Leviton Manufacturing Co., Inc., Little Neck, N.Y.

[21] Appl. No.: 09/131,086

[22] Filed: Aug. 7, 1998

[51] Int. Cl.[6] ..... H01R 13/70

[52] U.S. Cl. ..... 200/51 R

[58] Field of Search ..... 200/51 R, 51.12, 200/51 LM, 293.1; 439/620

[56] References Cited

U.S. PATENT DOCUMENTS

| | | | |
|---|---|---|---|
| 1,987,025 | 1/1935 | Peterson | 200/51 R |
| 2,529,845 | 11/1950 | Lockwood | 439/620 X |
| 2,567,962 | 9/1951 | O'Brien et al. | 200/51 R |
| 3,828,151 | 8/1974 | Bunnell et al. | 200/459 |
| 4,295,018 | 10/1981 | Borrelli | 200/51.12 X |
| 4,463,228 | 7/1984 | Osika | 200/51 R |
| 5,070,219 | 12/1991 | Grosskrueger et al. | 200/51 LM X |
| 5,238,428 | 8/1993 | Brakenridge et al. | 439/610 |

*Primary Examiner*—Renee S. Luebke
*Attorney, Agent, or Firm*—Paul J. Sutton

[57] ABSTRACT

Each free end of a severed single conductor is bared and attached to a different terminal member by means of a terminal screw. The terminal members are each coupled to a contact of a rocker type switch. When in a first position a bridging element contacts both contacts of the switch and closes the circuit through the severed conductor. The rocker when placed in a second position permits the bridging element to open the circuit through the severed conductor.

7 Claims, 4 Drawing Sheets

IN-LINE SWITCH ASSEMBLY

BACKGROUND OF THE INVENTION

1. Field of the Invention

The invention is directed to an on/off switch assembly for electrical devices and more particularly to an on/off switch assembly which can be installed in the electrical conductors powering such electrical devices.

2. Summary of the Invention

The invention is directed to an in-line on/off switch assembly installable in the power lines to electrical devices. The switch assembly makes use of a switch member with two contacts which extend from the switch member and a bridging device, internally, which can bridge the two contacts to close a circuit or allow the bridging device to open the path between the two contacts and open the circuit. The bridging device is operable by a rocker means which extends from the switch member. A first terminal member is jointed to a first switch contact at a first end and is fitted with a terminal screw at its second end to receive a first portion of a first conductor. A second terminal member is joined to a second switch contact at a first end and is fitted with a terminal screw at its second end to receive a second portion of the first conductor. When the bridging device bridges the first and second contacts the first conductor is complete and the circuit is closed. The rocker means can be operated to allow the bridging device to open the path between the first and second contacts and open the circuit. A housing is placed about the switch member and the first and second terminal members. An entrance and an exit aperture in the housing permit the electrical cord to enter and exit the housing. Strain relief devices at the entrance and exit apertures protect the switch assembly and the internal connections. It is an object of the invention to provide a novel in-line electrical switch.

It is an object of the invention to provide a novel in-line electrical switch which employs a rocker switch member.

It is another object of the invention to provide a novel in-line electrical switch wherein a conductor of an electrical cord is fixed in place by terminal screws.

It is still another object of the invention to provide a novel in-line electrical switch wherein terminal members couple a conductor of an electrical cord to a switch member.

Other objects and features of the invention will be pointed out in the following description and claims and illustrated in the accompanying drawings, which disclose, by way of example, the principles of the invention, and the best mode which is presently contemplated for carrying them out.

BRIEF DESCRIPTION OF THE DRAWINGS

In the drawings in which similar elements are given similar reference characters.

DESCRIPTION OF THE PREFERRED EMBODIMENT

Figure 1:
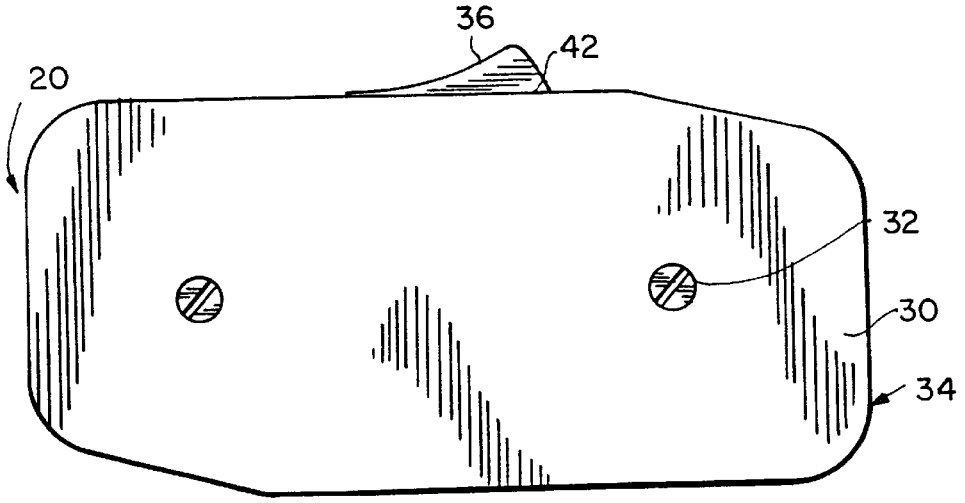
FIG. 1 is a top plan view of an in-line switch assembly constructed in accordance with the concepts of the invention.
Figure 2:
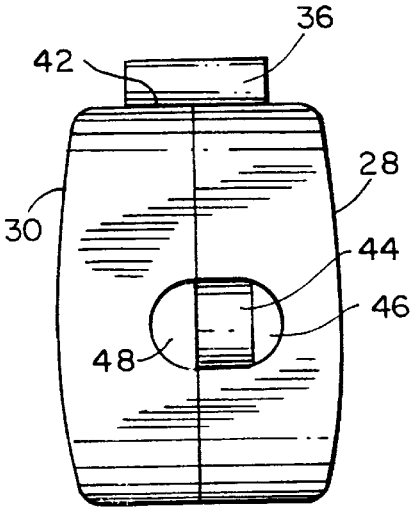
FIG. 2 is a side elevational view of the switch assembly of FIG. 1.
Figure 3:
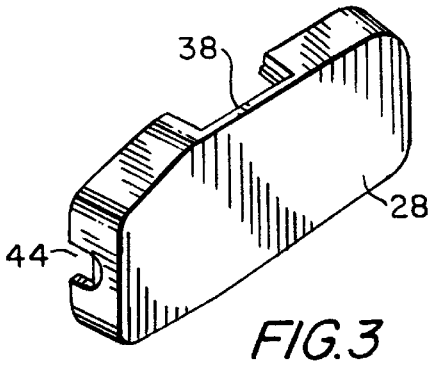
FIG. 3 is a perspective view of the rear of the base housing portion of the switch assembly of FIG. 1.

Turning now to FIGS. 1 to 10 there is shown an in-line switch assembly 20 constructed in accordance with the concepts of the invention and shown connected to one conductor 22 of a two conductor, side-by-side electrical cord 26 of the type normally used to supply power to electrical devices. The switch assembly 20 is made up of a base housing portion 28 and a cover housing portion 30 and when assembled by means of fasteners 32 form a complete housing 34. A rocker 36 partially extends out of aperture 42 made up of slots 38 in base housing portion 28 and 40 in cover housing portion 30. Only one end of rocker 36 extends above the housing 34 depending upon the state of the switch assembly 20. An entrance aperture 44 is formed in base housing portion 28 and is bounded by a removable tab 46. For electrical cords that can be fully accepted in entrance aperture 44, tab 46 engages the cord 26 to provide strain relief. If the cord 26 has a diameter greater than entrance aperture 44, tab 46 can be removed. Cover 343 housing portion 30 also has a removable tab 48 aligned with tab 46. The tab 48 acts as strain relief and can be removed for larger diameter cords. The exit aperture 50 is similar to entrance aperture 44.

Figure 4:
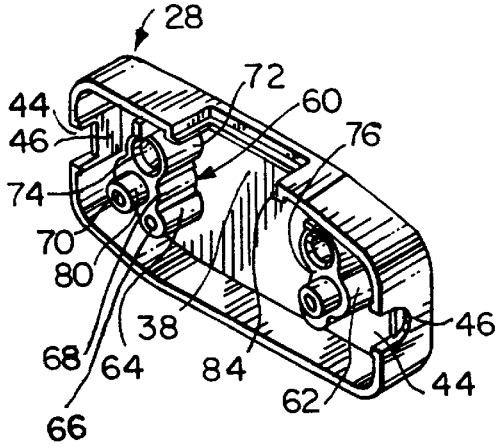
FIG. 4 is a perspective view of the front of the base housing portion of FIG. 3.
Figure 6:
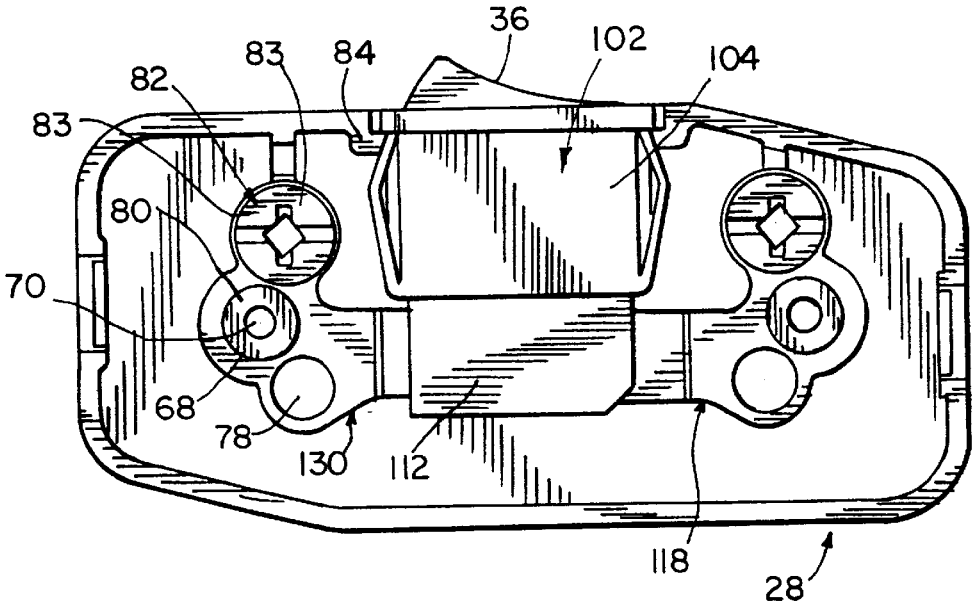
FIG. 6 is a top plan view of the base housing portion with all components of the switch assembly mounted therein.
Figure 7:
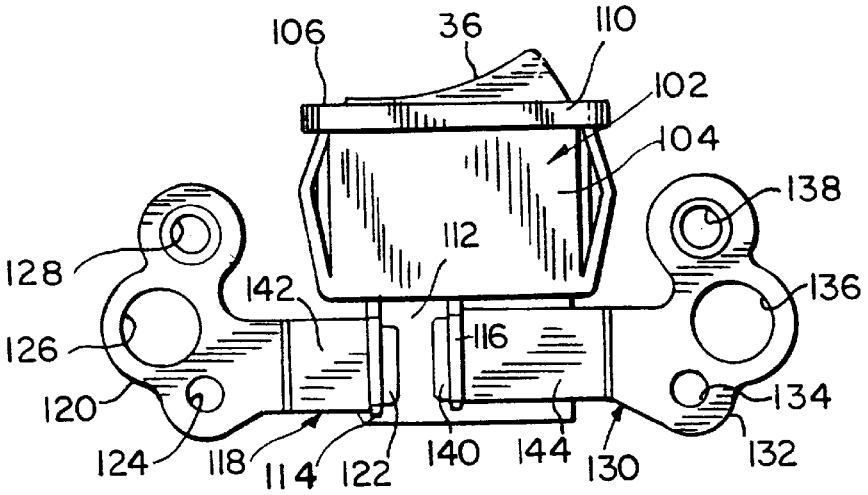
FIG. 7 is a bottom plan view of the switch member and terminal members assembled.
Figure 8:
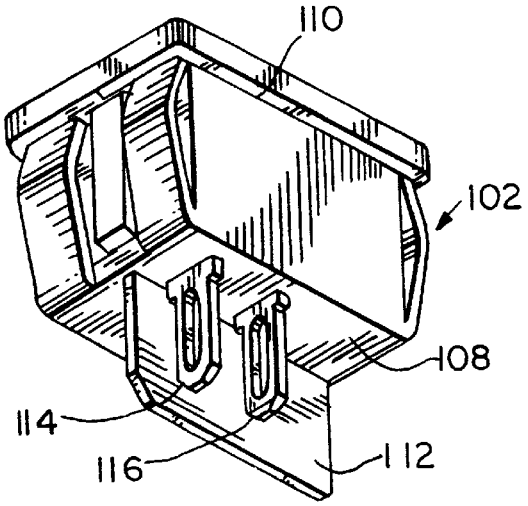
FIG. 8 is a bottom perspective view of the switch member of FIG. 7.

Referring to FIGS. 4 and 6 the interior structure of base housing portion 28 is shown. A three hub unit 60 is positioned to the left of slot 38 and another three hub unit 62 is positioned to the right of slot 38. Units 60 and 62 are mirror images of one another and only unit 60 will be described. Hub 64 joins hub 68 and hub 68 joins hub 72. The fillets between the hubs form a base 76. Aperture 66 in hub 64 receives a rivet 78 to fasten the terminal members to the base housing portion 28. Hub 68 has an extension 80 above the height of hubs 64 and 72 but has a diameter less than base 76. An aperture 70 in hub 68 and extension 80 receives the threaded portion of fasteners 32 to hold housing 34 in its assembled condition. Base 76 supports a portion of the terminal member as will be described below. The aperture 74 in hub 72 receives a terminal screw 82 which engages the bared end of a conductor which is wrapped about the terminal screw 82 under its head 83 and mechanically and electrically joins a conductor to the terminal member. A rib 84 extends about the slot 38 to help support the switch member as will be described below.

Figure 5:
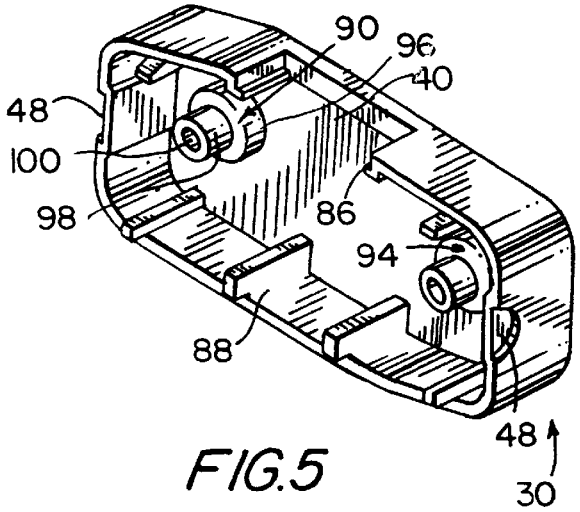
FIG. 5 is a perspective view of the front of the cover housing portion.

The interior of cover housing portion 30 is shown in FIG. 5. A rib 86 surrounds the slot 40 to help support the switch member when housing 34 is completed. Strengthening and positioning ribs 88 are positioned around the inner periphery of cover housing portion 30 and extend beyond cover housing portion 30 to enter into base housing portion 28 when portions 28 and 30 are assembled into housing 34. Two columns 90,94 extend from the interior surface of the cover housing portion 30. Each column 90,94 is made up of a circular first portion 96 and a circular second portion 98 having a diameter less than first portion 96. A bore 100 extends through second portion 98 and is counter bored in first portion 96. The bore 100 is aligned with aperture 70 in hub 68 when portions 28,30 are assembled. The head of fastener 32 is received in the counter-bored portion of bore 100 and the threaded body of the fastener 32 extends through bore 100 into aperture 70 of hub 68. The threaded body of fastener 32 cuts corresponding threads in the walls surrounding aperture 70.

Turning now to Fibs. 6 to 9 the details of the switch member 102 and the terminal members 118 and 130 are now set forth. Switch member 102 has a body 104 which includes a top face 106 and a bottom surface 108. Rocker 36 extends through top face 106 to permit a user to operate switch member 102. Top face 106 extends beyond the body 104 to form a rib 110 extending around the body 104 to engage ribs 84 and 86 to position and support switch member 102 in housing 34. Extending below bottom surface 108 generally parallel to the longitudinal axis of switch member 102 is an insulation barrier 112. A first contact 114 and a second contact 116 extend from bottom surface 108 and along the barrier 112. It should be understood that when switch member 102 is positioned as shown in FIG. 6 barrier 112 will prevent contact with the first and second contacts 114,116 respectively.

A first terminal member 118 has a first end 120 to be positioned over the three hub unit 62 and a second end 122 to be placed in the slot of first contact 114. The first end 120 has the same shape as the three hub unit 62 and has apertures 124, 126 and 128 aligned with hub apertures 66, 70 and 74 respectively. The second end 122 is soldered, welded, brazed, bonded, glued on otherwise coupled to the first contact 114. Second terminal member 130 has a first end 132 in the same shape as three hub unit 60 and arranged to be positioned over such unit with apertures 134,136, 138 aligned with hub apertures 66,70 and 74. Second end 140 enters the slot of second contact 116 and is attached thereto in the same manner as the first terminal member 118. The tongues 142,144 of the first and second terminal members, respectively, are of different lengths to accommodate the off-center placement of first and second contacts 114,116, respectively.

Figure 9:
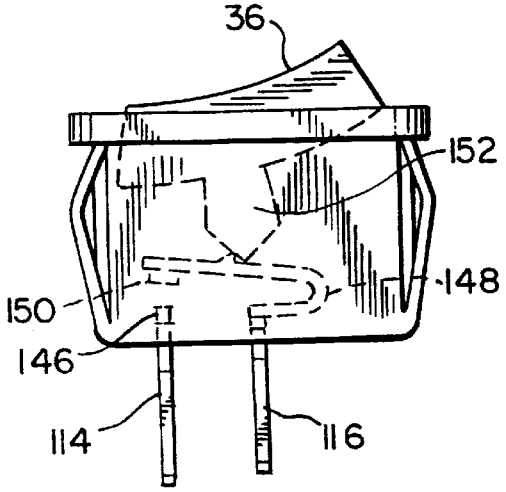
FIG. 9 is a front elevational view of the switch member of FIG. 7 and showing in phantom line the internal structure of the switch member.

First contact 114 terminates in a fixed contact 146 in body 104. Second contact 116 is connected to a resilient, flexible, bridging element 148 which carries movable contact 150. An activator 152 can be positioned by rocker 36 out of contact with bridging element 148 as shown in FIG. 9 and the natural resilience of the bridging element 148 separates movable contact 150 from fixed contact 146 and opens the circuit. When the rocker 36 is moved to its other position, actuator 152 engages the bridging element 148 and moves it in a counterclockwise direction causing movable contact 150 to engage fixed contact 146 and close the circuit. That is, there will be a conductive path from first terminal member 118 to first contact 114, fixed contact 146, movable contact 150, bridging element 148 to second contact 116 to second terminal member 130.

Figure 10:
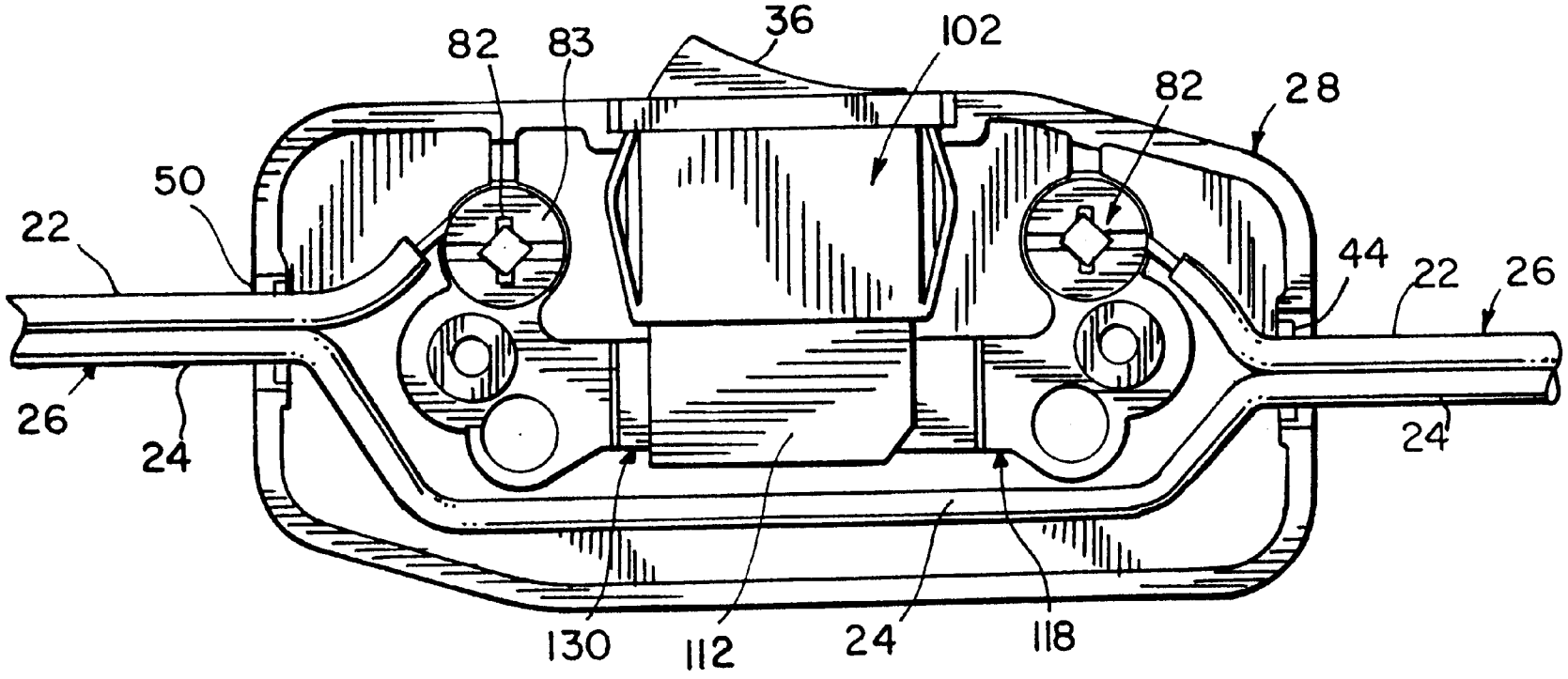
FIG. 10 is a top plan view of the switch assembly of FIG. 6 with an electrical cord connected.

Turning to FIG. 10 the method of using the in-line switch assembly 20 is shown. The two conductors 22,24 of electrical cord 26 are separated from one another, for approximately the length of the base housing portion 28. The first conductor 22 is severed at its midpoint and the insulation is removed at each of the conforming ends of conductor 22 to bare the central conductor thereat One end of conductor 22 is fastened to first terminal member 118 by means of terminal screw 82 as is well known in the art. The second free end of conductor 22 is fastened to second terminal member 130 by means of a terminal screw 82. Conductor 24 is made to bypass the first terminal member 118 and the second terminal member 130 within the base housing portion 28. The ends of the conductor 22 can be cut to size to fit within the base housing portion 28. The position of the bridging element 148 will now determine whether the circuit is open or closed as set forth above.

While these have been shown and described and pointed out the fundamental novel features of the invention as applied to the preferred embodiment as presently contemplated for carrying them out, it will be understood that various omissions and substitutions and changes of the form and details of the device illustrated and in its operation many be made by those skilled in the art, without departing from the spirit of the invention.

I claim:

1. An in-line switch assembly comprising:

a) a switch member having a rocker lever extending therefrom, said switch member capable of opening and closing an electrical circuit; said switch member having a first depending contact with a first slot therethrough and a second depending contact with a second slot therethrough;

b) a base housing portion having a partial electrical cord entrance, a partial electrical cord exit and a partial switch member slot, said base housing portion having two three hub units, one three hub unit to each side of said partial switch member slot, each of said hubs having an aperture therein;

c) a cover housing portion having a partial electrical cord entrance, a partial electrical cord exit and a partial switch member slot, said cover housing portion having two columns, one column to each side of said partial switch member slot, each of said columns having an aperture therein;

d) a joining of said base housing portion and said cover housing portion forms a complete housing and completes said partial electrical cord entrance, said partial electrical cord exit and said partial switch member slot with said rocker lever extending through said completed switch member slot;

e) a first terminal member having a first end and a second end, said first end inserted through said first slot in said first depending contact and coupled to said first depending contact, said second end of said first terminal member fixed to one of the three hubs in one of said two three hub units, said second end of said first terminal member further having a first terminal screw to fix a first bared end of a first electrical conductor to said first terminal member; and f) a second terminal member having or third end and a fourth end, said third end inserted through said second slot in said second depending contact and coupled to said second depending contact, said fourth end of said second terminal member fixed to one of the three hubs in the other one of said two three hub units, said fourth end of said second terminal member further having a second terminal screw to fix a second bared end of said first electrical conductor to said second terminal member, whereby when said rocker lever is in a first position said first and second bared ends of said first electrical conductor are joined and an electrical circuit is completed and when said rocker lever is in a second position said first and second bared ends of said first electrical conductor are not joined and an electrical circuit is open.

2. An in-line switch assembly, as defined in claim 1, wherein said partial electrical cord entrance and exit of said base housing portion are each made up of a slot and first removable tab which first removable tabs provide strain relief when present or an enlarged electrical cord entrance and exit when removed.

3. An in-line switch assembly, as defined in claim 1 wherein said partial electrical cord entrance and exit of said cover housing portion are each blocked by a second removable tab which second removable tabs provide strain relief when present or an enlarged electrical cord entrance and exit when removed.

4. An in-line switch assembly, as defined in claim 1, wherein:

a) said partial electrical cord entrance and exit of said base housing portion are each made up of a slot and a first removable tab and b) said partial electrical cord entrance and exit of said cover housing portion are each blocked by a second removable tab whereby each of said complete electrical cord entrance and said complete electrical cord exit provides a slot of a first size when said first and second removable tabs are present, and provides strain relief to said electrical cord by means of said first and second removable tabs, and each of said complete electrical cord entrance and said complete electrical cord exit provides a slot of a second size when said first removable tab is absent and said second removable tab is present, and provides strain relief to said electrical cord by means of said second removable tab, and each of said complete electrical cord entrance and said complete electrical cord exit provides a slot of a third size when said second removable tab is absent and said first removable tab is present, and provides strain relief to said electrical cord by means of said first removable tab and each of said complete electrical cord entrance and said complete electrical cord exit provides a slot of a third size when aid first and second removable tabs are absent.

5. An in-line switch assembly, as defined in claim 1, wherein said base housing portion has a first rib about said partial switch member slot and said cover housing portion has a second rib about said partial switch member slot, said first and second ribs, when said base housing portion and said cover housing cover are joined providing a continuous rib to support said switch member in said complete housing.

6. An in-line switch assembly, as defined in claim 1, wherein said first terminal screw is received in a second of the three hubs in said one of said two three hub units and said second terminal screw is received in a second of the three hubs in said other one of said two three hub units.

7. An in-line switch assembly, as defined in claim 1 wherein said apertures in each of said two columns extend through a surface of said cover housing portion, and said columns are each placed adjacent one of the three hubs in each of the two three hub units when said housing is complete to permit fasteners to be inserted through each of said columns and into an associated one of the three hubs in each of the two three hub units to hold the cover housing portion and base housing portion in assembly.

* * * * *